United States Patent [19]

Andersson

[11] 4,354,575

[45] Oct. 19, 1982

[54] GOODS CONVEYOR TRACK

[75] Inventor: Curt E. Andersson, Katrineholm, Sweden

[73] Assignee: Kurt Göran Andersson, Sweden

[21] Appl. No.: 141,924

[22] Filed: Apr. 21, 1980

[30] Foreign Application Priority Data

Apr. 25, 1979 [SE] Sweden ..... 7903604

[51] Int. Cl.[3] ..... B66B 9/06

[52] U.S. Cl. ..... 187/12; 198/321; 198/473; 198/678; 198/795

[58] Field of Search ..... 198/321, 473, 477, 678, 198/795; 187/12; 193/35 TE

[56] References Cited

U.S. PATENT DOCUMENTS

| | | | |
|---|---|---|---|
| 859,252 | 7/1907 | Reno | 198/321 |
| 2,424,055 | 7/1947 | Rousseau | 198/795 |
| 2,877,886 | 3/1959 | Braid | 198/795 |
| 3,577,930 | 5/1971 | Rooklyn | 198/678 |
| 3,749,202 | 7/1973 | Puls | 187/12 |
| 3,876,060 | 4/1975 | Stease | 193/35 TE |
| 4,179,012 | 12/1979 | Heberle | 187/12 |

*Primary Examiner*—Joseph E. Valenza

*Attorney, Agent, or Firm*—Burns, Doane, Swecker & Mathis

[57] ABSTRACT

A goods conveyor wherein the goods are placed on a supporting surface connected with a conveyor member forming part of the goods conveyor track. The conveyor member is made up of a number of units placed in a tubular shaped guide. The unit is movable in the guide by means of a driving member. The supporting surface is connected with one of the units or is connected with a special member placed between two units. A displacement of the units in the guide also brings about a displacement of the supporting surface. The guide acts as a handrail in a staircase and the longitudinal slit faces downwards. The supporting surface is rotatably fixed to one end of the holder, the other end of which has a spherically-shaped part. The supporting surface can assume a vertical position and a horizontal position intended for the conveying of goods. The other end of the holder has also a sliding surface, usually a wheel, to cooperate with a sliding track oriented along the staircase.

16 Claims, 9 Drawing Figures

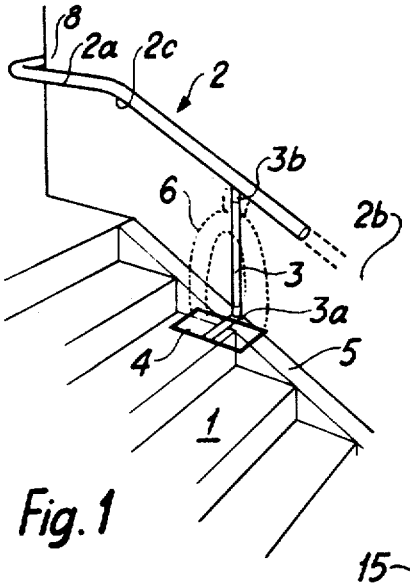
Fig. 1
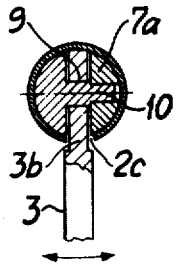
Fig. 2
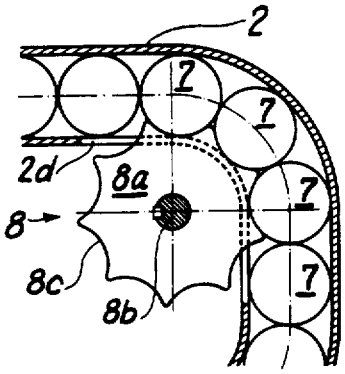
Fig. 3
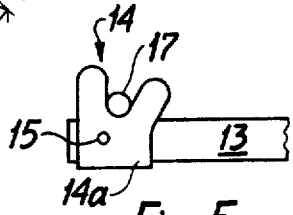
Fig. 5
Fig. 6
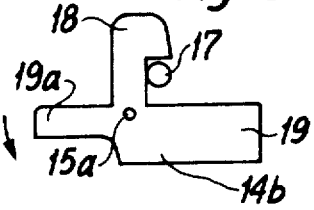
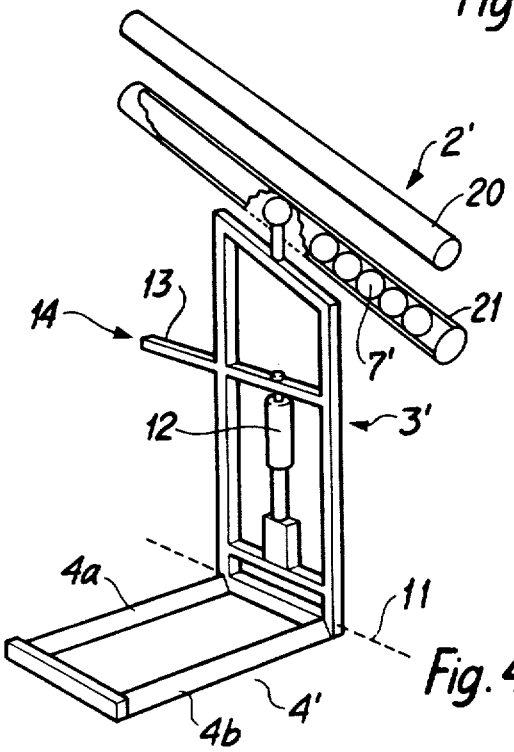
Fig. 4
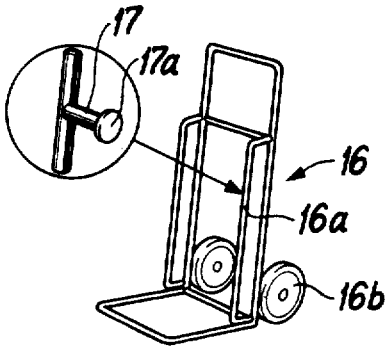
Fig. 7

GOODS CONVEYOR TRACK

TECHNICAL FIELD

The present invention relates to a goods conveyor track and preferably to such a goods conveyor track on which the goods are placed on a supporting surface which is joined to a conveyor member forming part of the goods conveyor track and where the goods are usually placed under the goods conveyor member.

PRIOR ART

A number of various goods conveyor tracks are already known per se in which the actual track is placed over the goods, but the common drawback of all these earlier known conveyor tracks is that they are expensive to install, and of complicated construction, perhaps specially with regard to the fact that said goods conveyor tracks are dimensioned for high loads.

Also already known per se, through U.S. Pat. No. 2,877,886, is a goods conveyor track on which the goods are placed on a supporting surface joined to a conveyor member forming part of the goods conveyor track. The conveyor member is made up of a number of balls disposed in two-parallel-oriented tubes, and wherein the tube is formed with a longitudinal slit to constitute a free passage for the supporting surface intended for the goods, in the form of light valves for internal combustion engines.

THE TECHNICAL PROBLEM

It has long been something to be wished, and a problem, to be able to effect the simple arrangement and installation of a goods conveyor track for loads up to 50–100 kg.

Especially in the case of the handling of refuse it has been found very troublesome to carry refuse bags up and down stairs, with serious back injuries as a consequence, and therefore it has been a particular desideratum and a considerable problem to be able to arrange a goods conveyor track in this technical field.

The goods conveyor track for the technical field mentioned hereinabove must be designed in such a manner that it merges easily into the surroundings of a staircase without, on that account, unnecessarily loading, or being a hindrance for, the normal function of the staircase.

Especially in the case of the handling of refuse and of the problem of having to carry bags or refuse up and down stairs, a problem has been found to lie in being able to secure cooperation between the goods conveyor track and the arrangement carrying the load. Especially in the case where a carriage is used to transport a bag of refuse or a dustbin, there is a particular desideratum in being able to place in simple manner the carriage on an underlying surface, securing the carriage to the conveyor track and thereafter allowing the carriage with the load to be transported along the conveyor track.

It has also been a problem to provide a light conveyor intended for staircases where the conveyor is to be able to support and transport persons unable to move even when the latter require a wheelchair or similar appliances.

A fact which quite generally applies to ball conveyors is that the balls loosely placed in a guide tube are imparted movements of rotation directed against each other by the motion, which gives rise to friction losses.

If the balls are chosen with a considerably smaller diameter than the diameter of the tube, say, about 2 mm, this would bring about that on a pressure being exerted on the balls every other ball will lie against the roof section of the tube and every other ball will lie against the bottom section of the tube, a circumstance which not only produces friction losses but also normally produces clattering.

Against this background it is a desideratum that the ball tracks so constructed and the balls should not rub against one another with mutual speeds of rotation.

Finally, with the hitherto known constructions, it has been a problem to meet safety requirements whereby a voltage drop will stop and hold up the conveyor and whereby a conveyor breakdown will also stop and hold up the conveyor.

SUMMARY OF THE PRESENT INVENTION

The present invention is intended to provide a goods conveyor track which shows itself to be able to solve the above-indicated problems and where the conveyor track can be given the form of a handrail.

The solution lies preferably in that the transport member is made up of a number of units placed in a tubular guide, acting as a handrail. By means of allowing the units to be movable in the guide by means of a driving element, and of allowing the supporting surface for the load to be joined with one of these units or joined with a special element placed between two units, it becomes evident that a movement of the units in the guides also brings about a movement of the supporting surface.

According to a specially proposed embodiment the handrail will be tubular and the units will be made up of balls placed in said tube and having a diameter which is only insignificantly below the inner diameter of the tube. By constructing the guide with a longitudinal slit the holder for the supporting surface can extend through said slit and be imparted a displacement in the slit depending upon the displacement of the units in the guide.

So as not unnecessarily to load or hinder the normal function of the stairs when the conveyor track is not used, it is proposed according to the present invention that the supporting surface shall be rotatably mounted on one end of a holder, the opposite end of which has the above-mentioned ball-shaped part. In this way the supporting surface can assume a vertical position (position of rest) and a horizontal position intended for the conveying of goods. By causing the bottom end of the holder to have also a sliding surface, preferably in the form of a wheel,, it has been found that the conveyor track can be used in a very simple and effective manner in a staircase with a sliding track oriented along the staircase.

The present invention makes special reference to the possibility of having the holder designed with a fixing element which is intended to be able to cooperate with a load-bearing arrangement.

Even though the load-bearing arrangement may be given any desired form, the present invention provides an embodiment which is preferably intended to cooperate with a goods conveyor track with the above-indicated characteristics, and where the arrangement is constructed with a first securing element applicable to a holder, and able to cooperate with a second securing element, and where these securing elements are disposed on a part belonging to the arrangement.

The present invention specially provides for the arrangement to be made to consist of a carriage with a wheel forming part thereof, one end portion of the stand being formed with said second securing element in the form of an outwardly-extending axle.

Said axle will then cooperate with the first securing element consisting in a folding clamping arrangement.

The particularly prominent advantages that may be obtained with a goods conveyor track according to the present invention are that the goods conveyor track can be used as a handrail in a staircase, which means that the goods conveyor track does not unnecessarily obstruct the normal function of the staircase. It has further been found that the goods conveyor track according to the present invention is simple to install, at the same time as the constituent parts are simple to produce. This brings about that the complete goods conveyor track keeps within an economically-advantageous price range.

Furthermore, the present arrangement according to the invention enjoys the advantage that a load-supporting arrangement, substantially independently of its design, may be applied to the supporting surface and, as a result of the fact that the holder for the supporting surface is constructed with a securing element, this securing element can cooperate with the load-bearing arrangement.

The present invention is particularly advantageous in the event of the load-carrying arrangement consisting in a carriage with frame with wheels belonging thereto, and when the one side section of the carriage and frame is constructed with an outwardly-extending axle.

BRIEF DESCRIPTION OF THE ATTACHED FIGURES

An embodiment proposed for the present, showing the characteristics significant for the present invention, will be described in more detail with reference to the attached drawing wherein FIG. 1 shows in perspective a staircase with a goods conveyor track according to the present invention installed in it;

FIG. 2 shows in cross-section the one upper end of a holder, which end is intended to be inserted in the handrail or guide;

FIG. 3 shows in side view and section a driving element for the goods conveyor track;

FIG. 4 shows on an enlarged scale a supporting surface joined with the goods conveyor track by means of a holder;

FIG. 5 shows one portion of the first securing element;

FIG. 6 shows the other portion of a first securing element;

FIG. 7 shows in perspective a load-supporting arrangement in the form of a carriage with a second securing element applied;

DETAILED DESCRIPTION OF THE PREFERRED EMBODIMENT

Figure 8:
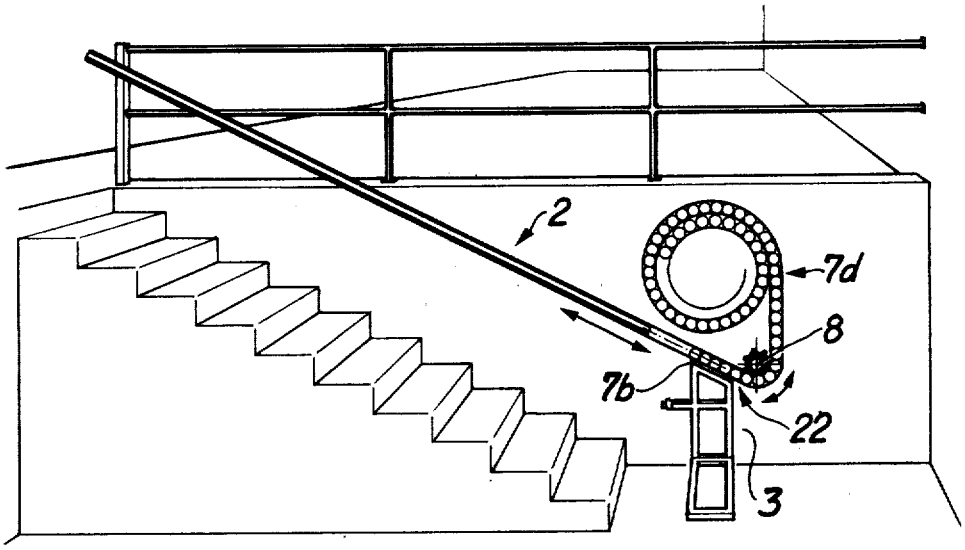
FIG. 8 shows in perspective a further embodiment of a goods conveyor track.
Figure 9:
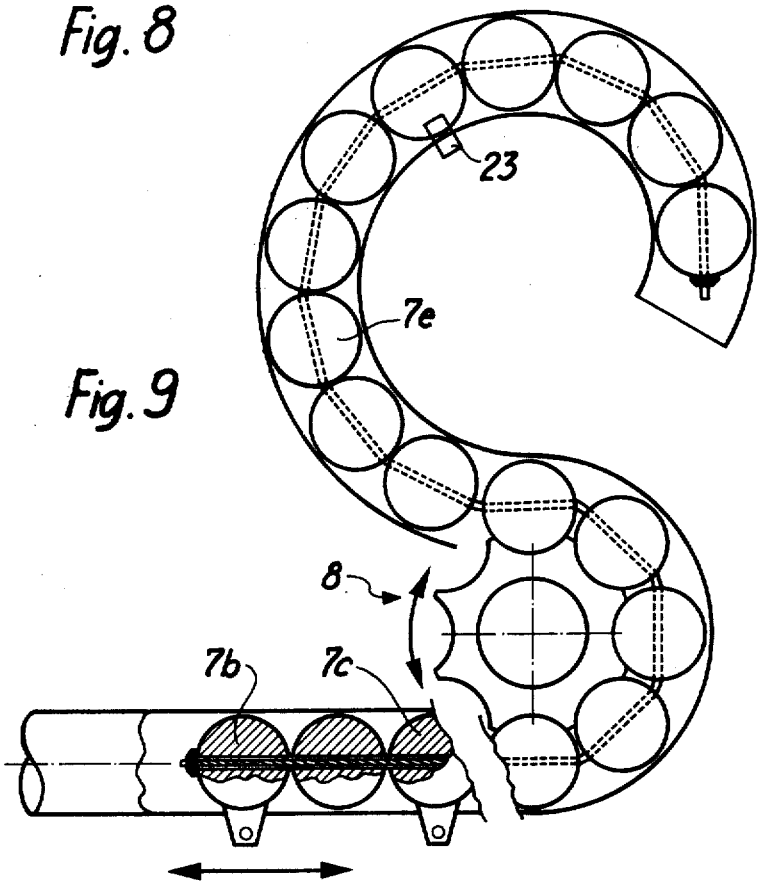
FIG. 9 shows on an enlarged scale a driving wheel and a magazine disposed near it.

FIG. 1 thus represents in perspective a staircase 1 which may be of any desired length, but in FIG. 1 only five stairs have been represented with a view to illustration. Connected to the staircase is a handrail 2, which also acts as a guide, a tubular guide, for the goods conveyor track. Extending downwards from guide 2 is a holder 3, where a supporting surface 4 is rotatably fixed to the one or bottom end 3*a* of the holder 3. The rotatable fixing formed there is not shown in detail on the attached drawing, but is thus formed of a hinge element and an abutment, which causes the supporting surface 4 to assume a position perpendicular to the holder 3 when the supporting surface assumes a folded-out position. The supporting surface can also assume a folded-up or vertical position not shown in the figure, i.e. a position parallel with the holder 3. The bottom portion 3*a* of the holder can also be advantageously provided with a running wheel (not shown) intended to apply and run against a gliding track 5 oriented along the staircase.

The goods conveyor track provided according to the invention is so designed that the goods 6, in the form of a refuse bag, may be placed on the supporting surface 4 which, in turn, by means of the holder 3, is connected to, or cooperates with the conveyor member 7 forming part of the goods conveyor track.

The conveyor member 7 is made up of a number of units placed in the tubular guide 2. The units are so placed relative to each other that they apply one against another. Through allowing unit 7 to be displaceable in the guide 2 by means of a driving element 8, and through allowing the supporting surface 4 to be joined to, or to cooperate with one of these units 7, or be connected with a special member 7*a* (FIG. 2) placed between two units 7, a displacement of the units 7 in the guide 2 brings about also a displacement of the supporting surface 4 along the stairs 1.

As mentioned earlier, the guide or handrail 2 is formed from a tube. The tube may have any desired cross-section, but in the example of embodiment it is shown that the tube has a circular cross-section. On the other hand the units may be made of balls 7 (steel balls, plastic balls, homogeneous or hollow balls). The guide 2 is constructed with a longitudinal slit from part 2*a* to part 2*b* through which the holder 3 can extend. The one end 3*a* of the holder 3 is, as FIG. 2 shows, formed with a hole 9, through which hole a pin 10 extends. The member 7*a*, furthermore, may be spherical. By means of this arrangement it is possible to arrange a rotation of the member 3 along the longitudinal extension of the slit 2*c*, while only a limited rotation can take place in the direction that is indicated by means of an arrow in FIG. 2. Member 7*a* is to be placed between the spherical transport members.

The longitudinal slit 2*c* faces downwards towards the staircase plan.

Driving member 8 is made of a wheel 8*a* connected to an axle 8*b*, which is rotatable in one of two directions by a drive motor not shown in the figure. The wheel 8, however, will have a toothed profile 8*c* which corresponds with the profile of units 7, and from the example of embodiment it will be clear that the tooth profile constitutes in one section part of a circumference. One may consider here allowing the toothed wheel to be to some extent bowl shaped to be able to apply perfectly against the conveyor member 7.

According to the present invention it is suggested in the first instance that the guide 2 should form an endless track, which is exactly filled with units 7, as a result of which a displacement of an unit will bring out a displacement of the other units in the same manner. However, if the driving member 8 can rotate the toothed wheel 8*a* in two directions, a track with an end may be used. However, what is important is to arrange for the driving member 8 to be so placed that the driving member 8 presses the units 7 to the left in FIG. 1 when the conveying is to be done up the stairs, while the units 7 will be able through their own weight and their mobility to move back when the driving member 8 changes direction of rotation.

Guide 2 is naturally constructed with a slit 2*d* connecting with the drive wheel 8*a* so that its teeth 8*c* may be brought into engagement with the units 7.

Irrespective of the fact whether the guide is made of an endless track or of a track with an end, an opening is needed in the guide for filling with units 7. This opening is not represented.

In the case of a guide with an end, the drive member 8 will be placed at a low level, that is to say at the lowermost portion of the stairs.

Accordingly, FIG. 4 shows on a somewhat enlarged scale a supporting surface 4' joined to a conveyor track 2' by means of a holder 3'.

The goods conveyor track 2' acts, as in the example of embodiment in FIG. 1, as a handrail in a staircase and consists of two tubes 20 and 21 placed opposite each other. If it is assumed that the drive arrangement according to FIG. 3 is placed at the bottom stair, pipe 20 will constitute a store of balls 7', and this pipe does not need to be formed with any slit, while the tube 21 contains the balls 7' and as a consequence presses the holder 3' along the stairs.

Both the tube 21 and the tube 20 can be used as handrails.

The supporting surface 4' consists of two triangular irons 4*a* and 4*b* orientated parallel relative to each other and are intended to serve as a supporting surface for a wheel on a load-bearing arrangement in the form of a carriage. The supporting surface 4', however, may be of any desired shape. The supporting surface is rotatably fixed through a rotating shaft 11 to the holder and a shock-absorbing arrangement 12 is disposed to absorb by its means the movement of rotation. The shock-absorber 12 is provided to prevent a clamping action between the supporting surface 4' and the holder 3' when the supporting surface 4' assumes a position parallel with the holder 3'. Holder 3' is provided with a small projecting beam 13 and at the end of said beam a first portion 14*a* of a first fixing member has been applied. The securing of the member 14*a* to the small beam may be effected by welding. The part 14*a* is constructed with a rotating shaft 15.

The first fixing member 14 consists in a second portion 14*b* which is provided with a hole 15*a* intended for a rotating shaft so that, by this means, part 14*b* can rotate relative to part 14*a*.

Thus the holder 3' is designed with a fixing member 14 intended to be able to cooperate with a load-supporting arrangement, which in FIG. 7 is illustrated as a carriage 16.

A second fixing member 17 able to cooperate with the first fixing member 14 applied on the holder 3' is disposed on a part 16*a* belonging to the arrangement. This implies that the frame portion 16*a* or side portion 16*a* of the carriage 16 is constructed with the fixing member 17 in the form of an outwardly-extending shaft, ending in a thicker collar 17*a*.

By placing the wheel 16*b* of the carriage 16 on the supporting surface 4' the shaft 17 can be placed in a recess in part 14*a*. Part 17 then comes to abut against part 18 of the part 14*b* and turns part 14*b* so that the shaft 17 can assume the position shown in FIG. 5. By means of designing the part 14*b* with a weight 19 part 14*b* comes to assume the position shown in FIG. 6 locking the shaft 17.

The load-supporting arrangement 16 is thus securely joined to the holder 3' and is supported by the supporting surface 4' in the transport along the goods conveyor track. When the actual transport is completed, part 19*a* rotates in the direction of the arrow, as a result of which action shaft 17 may be brought into engagement with the part 14*a* and the carriage may be removed from the supporting surface 4'.

The holder according to the present invention ensures redoubled safety in that the gearbox for the driving 8 is designed to be self-stopping which means that on a voltage drop the holder stops without being able to slide.

If any ball should break the holder does not slide downwards, as the holder is driven by a pressure, i.e. the driving wheel 8 is placed at the bottom of the stairs.

The construction shown makes it possible to use only one limit switch at the bottom portion of the track. The holder 3 can strike against the limit switch 22 and some of the last balls may be provided with a projection 23 which can strike against the limit switch.

FIG. 8 shows in perspective a further embodiment where the units in the form of plastic balls are joined together by means of a wire. The holder 3 is fixed to the balls 7*b* and 7*c* constituting the first in the ended track.

On the operation of the wheel 8 in one direction the balls 7*b* and 7*c* are pressed upwards along the guide 2. On operation in the other direction balls 7*b* and 7*c* are pulled downwards. The band 7*d* thus obtained is wound up in a magazine. This may consist according to FIG. 8 in a spiral-shaped track. It is also possible to have a magazine with the wall sections placed a little away from each other correspondingly to the thickness of the balls.

The units are formed here as plastic balls with a member fixing the balls in the form of a wire 7*e*. Naturally, the wire may be changed for a line, cable or the like. The plastic balls will slide along the guide made of metal.

In order to obtain an effective movement of displacement without disturbing rattling the cross-section of the ball must be 1 to 5 mm below the inner cross-section of the guide, preferably 1 to 3 mm below. The cross-section of the balls may be of up to 52 mm, while the inner cross-section of the guide will be of up to 54 mm. In this way it has been found that the movement of displacement is effected more easily at the driving wheel 8 and in the bends.

Naturally, the invention is not restricted to the embodiment given above as an example and it can undergo alterations within the scope of the following claims.

I claim:

1. A goods conveyor arranged along a staircase, comprising a supporting surface for goods connected with a conveyor unit forming part of a goods conveyor track, the conveyor track including a number of units placed in a single tubular shaped guide, a driving member for moving the units in the guide, an elongated member having a first end connected to the supporting surface and a second end suspended downwardly from one of said units, a displacement of the units in the guide causing a displacement of the supporting surface, the guide being oriented along the staircase with no portion of the supporting surface or the elongated member extending above said guide such that the guide is operable as a handrail for the staircase, a longitudinal slit in the guide facing downwards and receiving the second end of said elongated member, the first end of said elongated member has a wheel for rolling engagement with a track oriented on a wall adjacent the staircase, said elongated member lying in a vertical plane bounded by the guide and the track, said track supporting a substantial portion of the weight of said goods conveyor.

2. The conveyor according to claim 1, wherein the supporting surface can assume a vertical position, and a horizontal position intended for the conveying of goods.

3. The conveyor according to claim 1, wherein the conveyor unit connected to the second end of the elongated member includes a rotating shaft connected to the element such that the element can swing along the longitudinal direction of the slit in the guide.

4. The conveyor according to claim 1, wherein the drive member comprises a wheel with a toothed profile corresponding to a portion of the profile of the units.

5. The conveyor according to claim 1, wherein the slit is formed along only a portion of the guide.

6. The conveyor according to claim 4, wherein the guide includes a slit connected with the driving wheel, so that the teeth of the driving wheel can be brought into engagement with the units.

7. The conveyor according to claim 1, wherein the elongated member includes a fixing member adapted for holding a load-supporting arrangement.

8. The conveyor according to claim 1, wherein the supporting surface can assume a vertical position and a horizontal position intended for goods conveying, and further comprising a shock-absorber arranged to absorb the movement of rotation of the supporting surface from the horizontal to the vertical position.

9. The conveyor according to claim 1, wherein the guide forms an ended track which is partly filled with units.

10. The conveyor according to any one of the foregoing claims, wherein the units are made up of balls, and wherein a ball-securing member holds the balls adjacent one another.

11. The conveyor according to claim 10, wherein the ball-securing member is a wire arranged to pass through the balls.

12. The conveyor according to claim 10, wherein the units are made of a plastic material and the guide of a metal material.

13. The conveyor according to claim 10, wherein the diameter of each of the balls is 1 to 5 mm less than an inner diameter of the guide.

14. The conveyor according to claim 11, wherein the balls are able to be stored in a magazine placed adjacent the driving member.

15. The conveyor of claim 1, further comprising a load-bearing arrangement adapted to move with the goods conveyor, said load-bearing arrangement including a second securing element secured to the arrangement and adapted to cooperate with a first securing element secured to the elongated member to secure the arrangement to the member.

16. The conveyor according to claim 15, wherein the load bearing arrangement includes a carriage with a support, one side portion of the support includes said second securing element, said second securing element being an outwardly-extending shaft.

* * * * *